United States Patent [19]

Timson

[11] 4,128,667

[45] Dec. 5, 1978

[54] MANIPULATION OF COATING STREAMS WITH AIR FOILS

[75] Inventor: William J. Timson, Pocasset, Mass.

[73] Assignee: Polaroid Corporation, Cambridge, Mass.

[21] Appl. No.: 668,210

[22] Filed: Mar. 18, 1976

Related U.S. Application Data

[63] Continuation-in-part of Ser. No. 487,227, Jan. 10, 1974, abandoned.

[51] Int. Cl.[2] ..... B05D 3/04

[52] U.S. Cl. ..... 427/348; 118/62; 118/64; 118/65; 118/68; 118/600; 118/DIG. 4; 427/378; 427/420

[58] Field of Search ..... 427/378, 348, 420; 118/600, 100, 62, DIG. 4, 64, 65, 68, 123; 264/93

[56] References Cited

U.S. PATENT DOCUMENTS

| | | | |
|---|---|---|---|
| 2,995,469 | 8/1961 | LeClair | 427/348 |
| 3,272,176 | 9/1966 | Saydlowski | 118/63 |
| 3,404,025 | 10/1968 | Woolen | 427/420 |
| 3,445,270 | 5/1969 | Lorck | 427/348 |
| 3,513,017 | 5/1970 | Waters et al. | 110/DIG. 4 |
| 3,526,535 | 9/1970 | Pluma | 427/420 |
| 3,795,474 | 3/1974 | Heyer | 264/93 |
| 3,802,911 | 4/1974 | LaCamera et al. | 427/348 |
| 3,916,077 | 10/1975 | Damrau | 427/348 |

OTHER PUBLICATIONS

George Koch Sons & Inc. Bulletin, *Steinmann Pressure Curtain Coater* Evansville, Ind., Installation List, 1961, p. 23.

*Primary Examiner*—Ronald H. Smith
*Assistant Examiner*—Joyce A. Bell
*Attorney, Agent, or Firm*—John W. Ericson; Sheldon W. Rothstein

[57] ABSTRACT

The velocity of a free falling coating composition stream emitted from a coating applicator is altered prior to reaching a web by streams of gas directed over air foils situated immediately adjacent said coating composition stream.

6 Claims, 3 Drawing Figures

MANIPULATION OF COATING STREAMS WITH AIR FOILS

The present application is in part a continuation of U.S. patent application Ser. No. 487,227, filed on Jan. 10, 1974, now abandoned.

BACKGROUND OF THE INVENTION

The present invention is concerned with novel apparatus and procedures for applying a coating onto a substrate or web. More particularly, this invention relates to methods and apparatus for guiding a coating composition stream emitted from a coating applicator onto a moving web and for altering the velocity of the stream emitted from the applicator.

It is well known in the art to coat a moving web with fluid discharged from an applicator spaced away from the web. For example, fluid may be so emitted from extrusion or curtain coaters such as those described in Coating Methods Survey of the Encyclopedia of Polymer Science and Technology, Vol. 3, pp. 777–782 by D. G. Higgens where the fluid free falls onto a web.

To control coating thickness, fluid velocity, contact angle of the coating fluid and web, etc., changes can be made in the pressure of the fluid in the applicator opening, the speed of the web, etc. But once the fluid has left the applicator, it is in free fall, i.e., free from guidance or restraint in falling, until it has reached the web. The only known apparatus for protecting the fluid stream from outside forces during deposition comprises enclosure sheets for deflecting stray air current. While it is well known to direct a gas current toward a coating bead, or to apply a vacuum to a coating head, (see, for example, U.S. Pat. Nos. 3,503,370; 3,640,752 and 3,676,178), such manipulations are not directed to the coating stream prior to contact with the web, and are particularly not directed toward a stream of coating composition in free fall. Furthermore, the forces provided by these techniques act normal to, rather than parallel to, the coating composition film or stream.

Manipulation of a coating composition stream is very desirable in many instances. For example, it might be desired to intermittently deflect the angle at which the stream hits a web or to adjust the stream velocity so as to achieve proper coating. It might also be advantageous to deflect the stream away from the web so that coating can be stopped without shutting down the applicator. In addition by applying a vibratory action to the air foils an induced chatter can be imparted to the coating which may be useful for certain applications.

While employment of the present invention brings to mind numerous applications, clearly the principle advantage obtained in a conventional curtain coating system is the ability to accelerate the falling stream to enhance impingement of the stream against a moving web to get better contact and thereby permit higher web speeds.

OBJECTS OF THE INVENTION

It is therefore an object of this invention to provide apparatus and procedures for manipulating coating fluid emitted from a coating applicator prior to its deposition on a moving web.

It is also an object of this invention to provide apparatus and procedures for stabilizing a stream of coating composition during free fall.

Another object of this invention is to provide apparatus and procedures for deflecting the direction of travel of a stream of coating composition.

Still another object of this invention is to provide apparatus and procedures for altering the velocity at which said fluid stream is traveling.

SUMMARY OF THE INVENTION

A stream of gas directed over an air foil situated immediately adjacent a stream of free falling coating fluid may be utilized to alter the velocity of the fluid prior to its reaching the web being coated.

DESCRIPTION OF THE INVENTION

In accordance with the present invention, a free falling fluid stream emitted from a coating applicator can be manipulated prior to reaching a web by gas flowed over air foils located immediately adjacent the fluid stream. Such air foils comprise a generally curved surface adjacent the fluid stream. A gas stream conducted over the curved surface will follow its contour in air foil fashion and be directed generally parallel to the coating fluid stream. Boundary friction between the air conducted over the air foil and the stream of coating composition provide desired changes in velocity of the coating stream, i.e. concurrent flow would provide acceleration while countercurrent flow would provide deceleration. Air foils used herein may be shaped and oriented in accordance with the particular operations to be effected by their presence as long as they are situated immediately adjacent to the fluid stream, which may be comprised of one or more layers, so that gas passing over the foil will affect said stream. Preferably the air foils will be positioned along the entire width of the fluid stream and act uniformly thereover, though nonuniformity of action across the fluid stream may provide desired cross-web control.

When the air velocities on both sides of the stream are identical, the side-way forces are identical and the stream remains positioned in the middle. Yet, the aerodynamic drag of the air on the stream increases the velocity of the stream in the direction of the air stream travel, thereby increasing the film's momentum, and impact intensity on the web. When the air velocities on both sides of the stream are unequal, e.g., as by use of only one airfoil the side-way forces are not identical, and the stream will be deflected in the direction of lower pressure, which will be at the higher gas velocity side in accordance with Berneouli's theory. Thus, it is possible to use aerodynamic forces from the air foil effect to flip the stream back and forth very rapidly as desired by increasing or decreasing the relative air velocities on the two sides of the air stream. This flipping of the stream may be used to divert the stream into a slot beyond the air foil, which removes the coating solution and prevents it from being coated on the web to achieve intermittent coating on the web.

Varying the flow rates along the air foil (cross-web) aerodynamically can provide cross-web coating control.

The present invention produces an increase in the kinetic energy (momentum) of the free falling stream to improve impingement on the web and obtain uniform deposition at high web rates. The action of the air foils on air streams is described in numerous publications and is well known. To applicant's knowledge, however, air foils have never before been employed to alter the velocity of a free falling stream of coating fluid.

Figure 1:
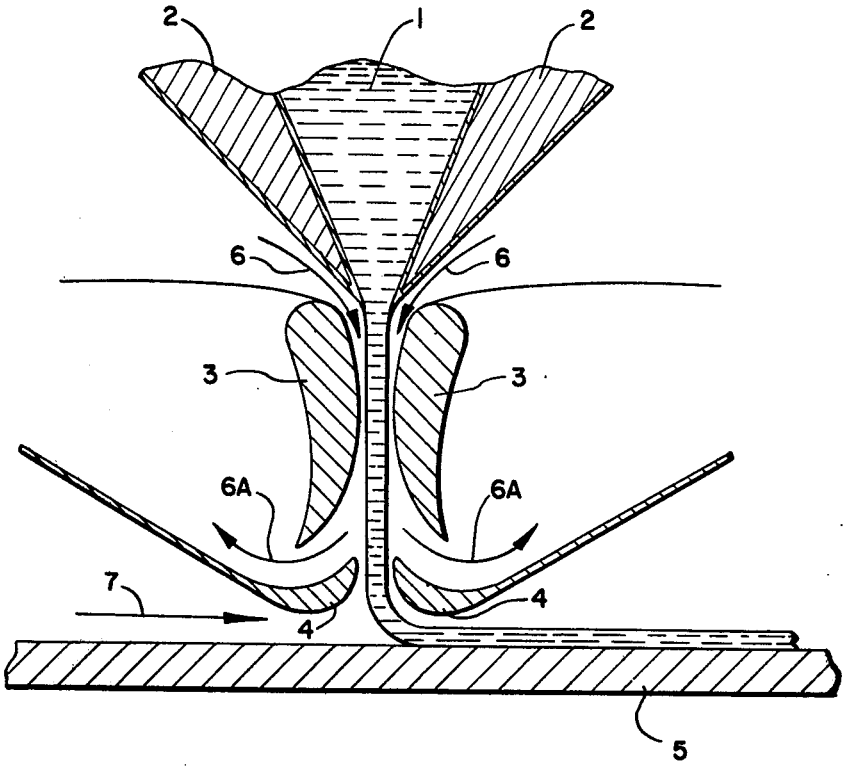
FIG. 1 is a cross sectional view of an air foil arrangement according to the present invention.

An example of one possible air foil arrangement is shown in FIG. 1. The direction of travel of web 5 is shown by arrow 7. The fluid, 1, emitted from the coating applicator, 2, is accelerated by two sets of air foils, each set comprising a pair of air foils, 3 and 4, on opposite sides of the fluid stream, between the applicator and the web. A gas such as air is directed over the foils in the direction of arrows 6 at a velocity which provides the desired stream acceleration and follows arrows 6a out of the system. Of course, other gases such as nitrogen, argon, freon, etc. may be utilized. As is readily apparent to one skilled in the art, the air velocity across the foil will be compatible with the air foil design (i.e., streamlined flow, no breakaway) and be effected by that design to provide the predetermined effect on the fluid stream. Directing gas over the foils may be accomplished with suitable pumps and regulators. While employment of foils in sets in this embodiment should give excellent results, good results should be obtained even if foils 4 were not present.

When it is desired to form an intermittent coating on a web an air foil arrangement such as that shown in FIG. 1 can be utilized by intermittently operating means for flowing gas over the air foils on one side of the fluid stream. For example, if the air flow across upstream foil 3 is stopped, coating fluid would follow the gas stream direction along the upper surface of downstream foil 4 and not be deposited onto the web. It could then be removed by a suitable vacuum arrangement. Such an arrangement is especially useful when the fluids being coated tend to crystallize out when coating is stopped. In such cases it is obviously desirable to deflect fluid away from the web rather than stopping the fluid flow.

Figure 2:
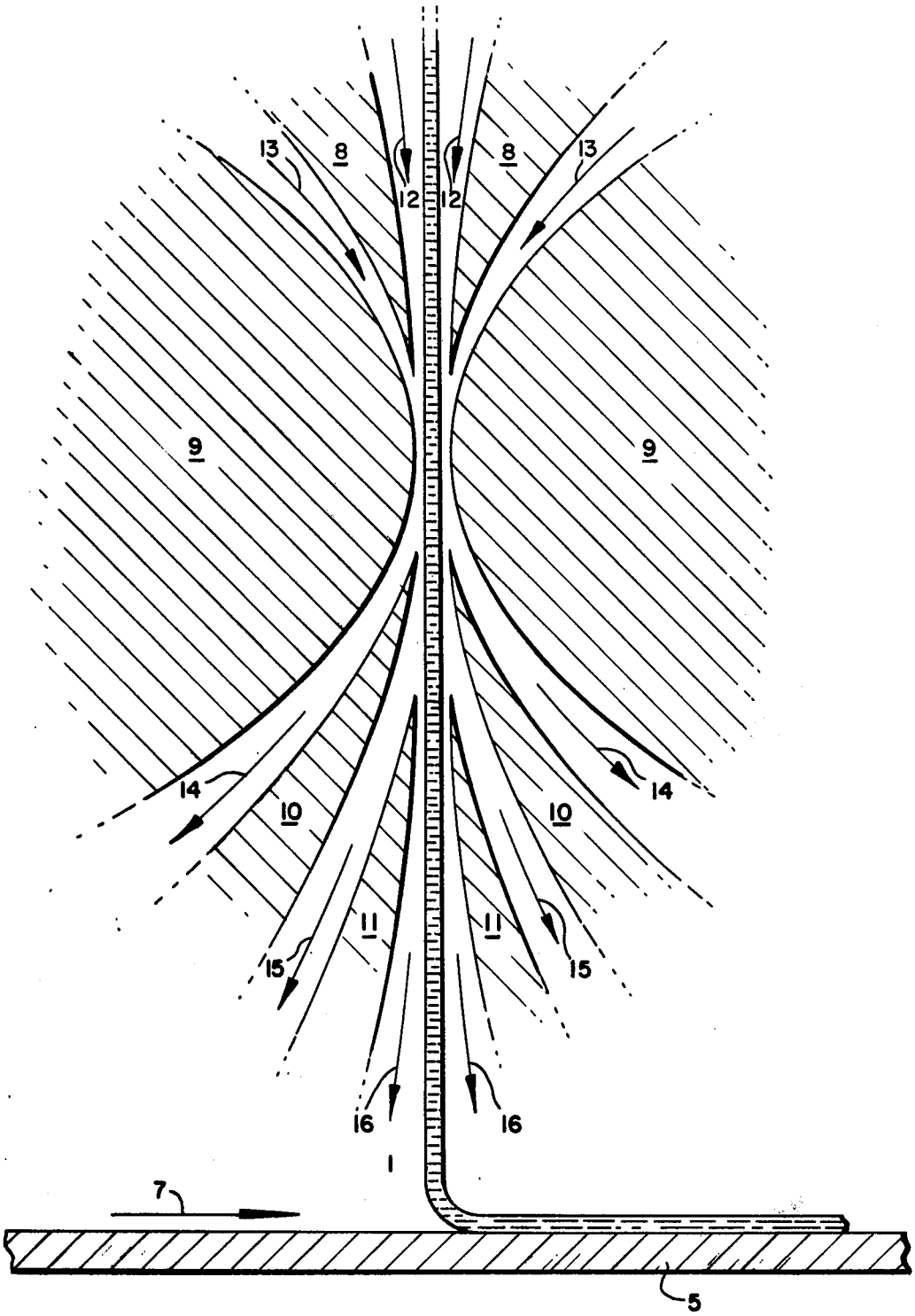
FIG. 2 is a cross sectional view of an air foil arrangement according to another embodiment of the present invention.

Referring now to FIG. 2, at stream of free falling fluid coating composition stream 1 is deposited upon web 5 moving in the direction of arrow 7. Located on each side of stream 1 are air foils 8, 9, 10 and 11, arranged in vertical order below the coating composition applicator immediately adjacent the fluid stream. Positive air pressure, denoted by arrows 12 and 13, is fed over the upper surfaces of foils 8 and 9. It will exit from the system through the channels denoted by arrows 14, 15 and 16. Additional accelerative force may be applied to the fluid stream by causing negative pressure to act upon the channels denoted by arrows 14, 15 and 16. This embodiment should provide fluid stream stability and excellent control of the accelerative forces applied to the fluid stream.

Figure 3:
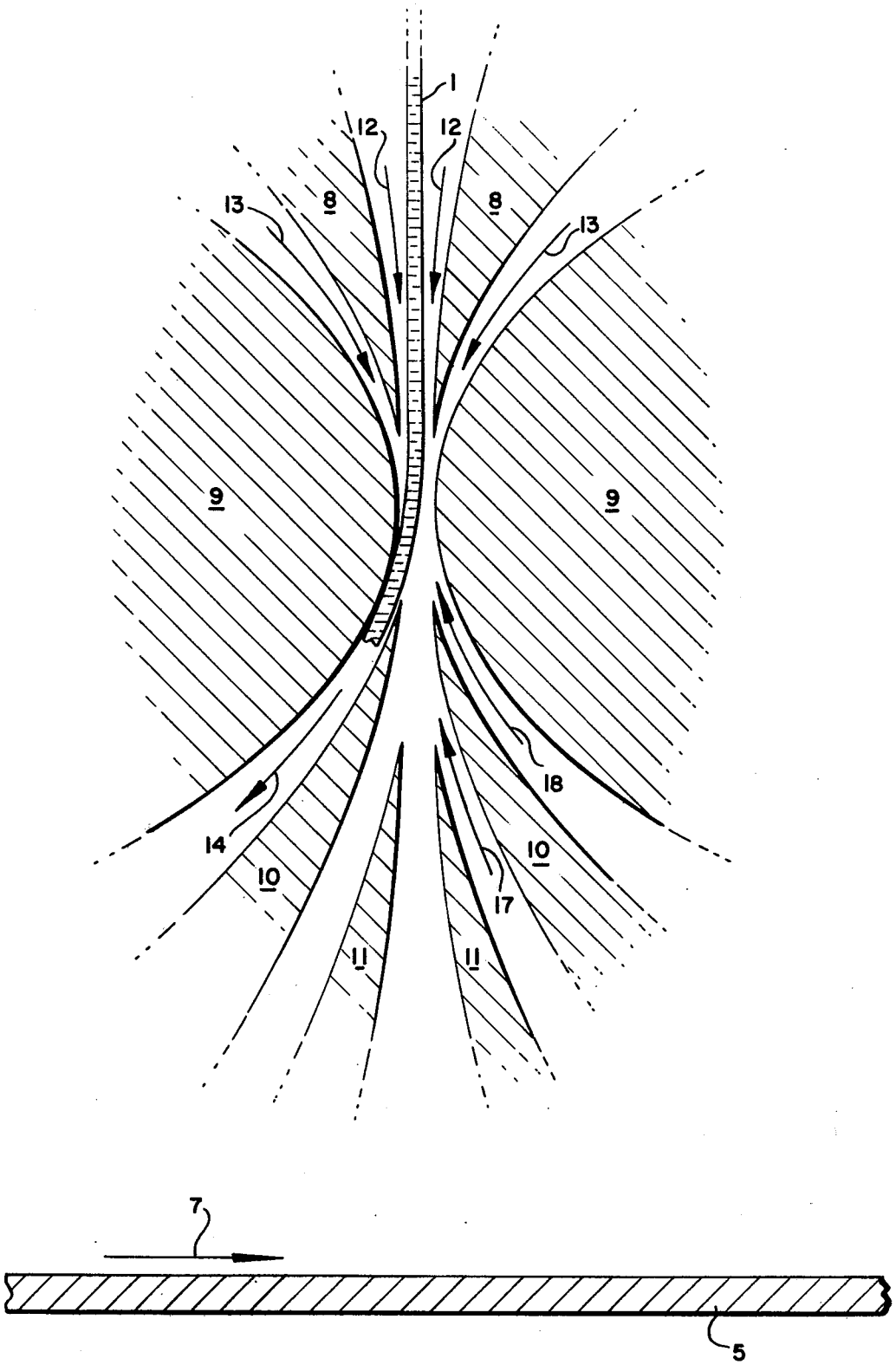
FIG. 3 is a cross sectional view of an air foil arrangement similar to the embodiment of FIG. 2 using more channels as positive flow channels.

FIG. 3 is essentially the same as FIG. 2, but depicts positive flow channels by downstream arrow 17 and downstream arrow 18 in lieu of the negative flow channels of FIG. 2. In this embodiment, coating composition 1 would never reach the web but would be removed by the path defined by upstream arrow 14.

Many other air foil arrangements are of course useful in conjunction with coating applicators spaced away from the web to permit substantial free fall of the coating composition to the web. The air foils themselves may be constructed out of any suitable material such as aluminum, stainless steel, teflon coated materials, etc. The gas directing apparatus may consist, for example, of conventional air moving devices, suction devices, etc.

The air foil gases may comprise or contain materials which affect the coatability or other physical and/or chemical properties of the fluid stream. For example, surface active materials such as methanol, ethanol or water (for an oily coating) may be added to the air foil gas to modify the surface tension and thereby improve wetting of the fluid.

Since substitutions and changes can be made in the above described apparatus and procedures without departing from the scope of the invention, it is intended that all matter in the foregoing description shall be interpreted as illustrative and not in a limiting sense.

What is claimed is:

1. In an apparatus which includes a means for dispensing a free falling stream of fluid coating composition onto a moving web;

the improvement which comprises at least one air foil located below said deposition means and positioned to be adjacent a stream of coating composition dispensed from said composition deposition means, and means for passing a stream of gas over the surface of the air foil immediately adjacent said stream of coating composition;

whereby the stream of gas passed over said air foil provides a frictional effect acting generally parallel to and upon said stream of coating composition and alters the free fall velocity of the stream of coating composition as it moves toward the web.

2. The apparatus of claim 1 including at least two air foils and means for passing a stream of gas over each of said air foils, said air foils being situated on opposite sides of said coating composition stream from one another.

3. The apparatus of claim 2 wherein at least one of said means for passing gas over said air foils is capable of causing a force to act upon said stream of coating composition which displaces said stream of coating composition from its free fall path.

4. A method for altering the free fall velocity of a free falling fluid coating composition stream dispersed from a coating applicator prior to reaching a moving web, said method comprising directing a stream of gas over at least one air foil having a surface situated immediately adjacent said stream of coating composition whereby a frictional effect acting generally parallel to and upon said stream of coating composition alters the free fall velocity of said stream of coating composition as it moves toward said web.

5. The method of claim 4 which includes passing streams of gas over at least two air foils, said air foils being situated on opposite sides of said stream of coating composition.

6. The method of claim 5 wherein gas is passed over at least one of said air foils so as to provide a force which displaces said stream of coating composition from its free fall path.

* * * * *